US007500867B1

(12) United States Patent
Doglio et al.

(10) Patent No.: US 7,500,867 B1
(45) Date of Patent: Mar. 10, 2009

(54) CABLE CLIP THAT SNAPS ONTO CONNECTOR HOUSING

(75) Inventors: Jean Doglio, Austin, TX (US); James McKinney, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 12/117,410

(22) Filed: May 8, 2008

(51) Int. Cl.
*H01R 13/62* (2006.01)

(52) U.S. Cl. ..... 439/371; 439/456; 248/251

(58) Field of Classification Search ..... 439/371, 439/449, 456, 953, 902, 304, 364
See application file for complete search history.

(56) References Cited

U.S. PATENT DOCUMENTS

| | | | | | |
|---|---|---|---|---|---|
| 3,629,787 | A * | 12/1971 | Wilson | 439/67 |
| 5,080,608 | A * | 1/1992 | Yarnton et al. | 439/457 |
| 5,564,944 | A * | 10/1996 | Fukuda | 439/521 |
| 5,921,805 | A * | 7/1999 | Tabata et al. | 439/457 |
| 5,934,818 | A * | 8/1999 | Schmitt et al. | 403/399 |
| 5,941,628 | A * | 8/1999 | Chang | 362/249 |
| 6,116,951 | A * | 9/2000 | Shu | 439/574 |
| 6,129,583 | A * | 10/2000 | Lok | 439/545 |
| 6,247,963 | B1 * | 6/2001 | Rattner | 439/502 |
| 6,340,306 | B1 | 1/2002 | Daoud | |
| 6,341,881 | B1 * | 1/2002 | Huang | 362/391 |
| 7,088,577 | B2 | 8/2006 | Lauffer et al. | |
| D532,379 | S | 11/2006 | Sorrentino et al. | |
| 7,156,683 | B2 | 1/2007 | Gupta et al. | |
| 7,234,958 | B1 * | 6/2007 | Copus | 439/371 |
| 2007/0037438 | A1 * | 2/2007 | Furuya et al. | 439/456 |

* cited by examiner

*Primary Examiner*—Neil Abrams
*Assistant Examiner*—Harshad C Patel
(74) *Attorney, Agent, or Firm*—Larson Newman Abel & Polansky, LLP

(57) ABSTRACT

A cable clip for a connector housing is configured to route a plurality of cables within a server. The cable clip includes a backing, a first portion, and a second portion. The backing configured to be placed in physical communication with the connector housing. The first portion extends from a first edge of a first side of the backing, and has a first hook opposite the first side of the backing. The first portion is adapted to flexibly slide over the connector housing and snap fit the first hook around the connector housing. The second portion extends from a second edge of the first side of the backing, and has a third hook opposite the first side of the backing. The second portion is adapted to flexibly slide over the connector housing and snap fit the second hook around the connector housing.

20 Claims, 9 Drawing Sheets

CABLE CLIP THAT SNAPS ONTO CONNECTOR HOUSING

FIELD OF THE DISCLOSURE

This disclosure generally relates to information handling systems, and more particularly relates to a cable clip for a cable in information handling systems.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

In a server rack, servers, network cards, and the like are connected together with and powered by a number of cables. The cables are routed to different locations within the server rack to make the connections that are needed and to provide the necessary power to the components of the server rack. There are various types of cable clips and routing features for the cables of the server rack. Some examples include cable clips that mount on sheet metal or a printed circuit board (PCB) with snaps, screws, clamps, hooks, or adhesive. In addition, some cable clips exist that hold two or more cables together.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

Figure 1:
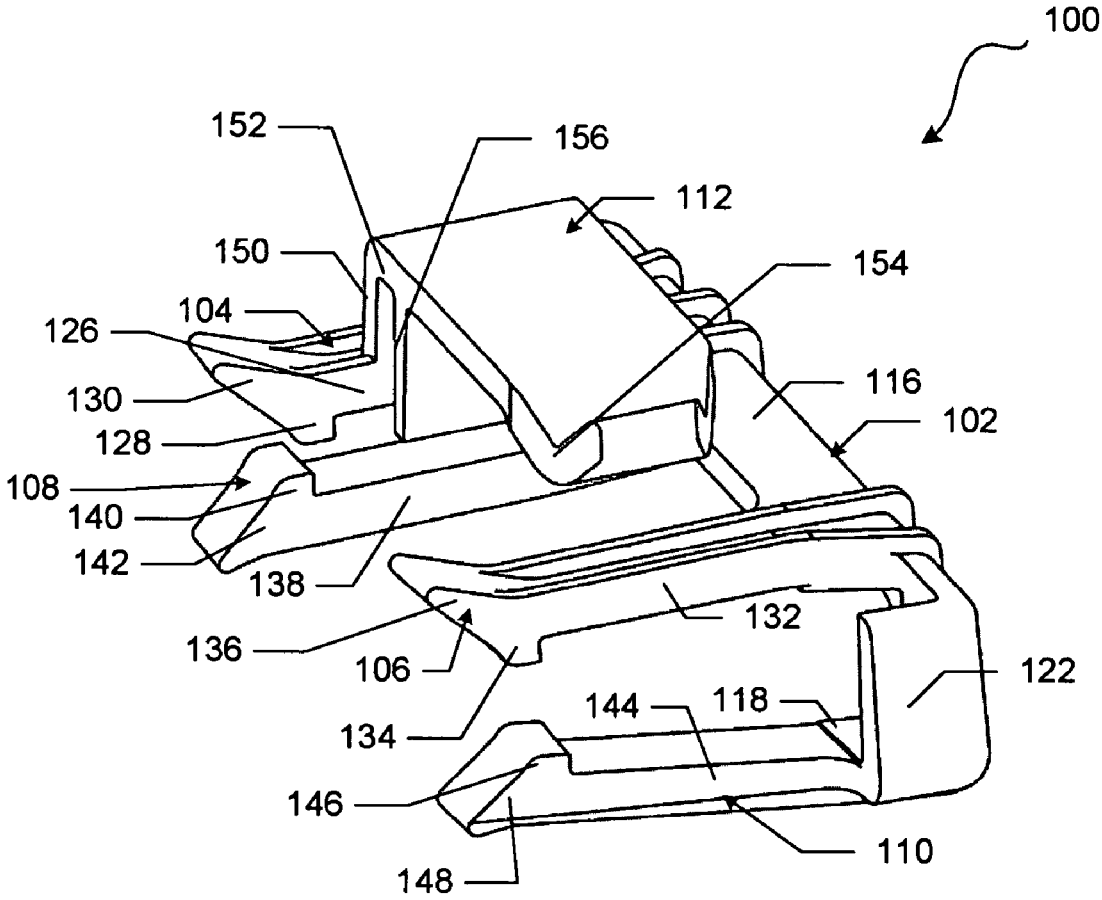
FIG. 1 is a perspective frontside view of a cable clip.
Figure 2:
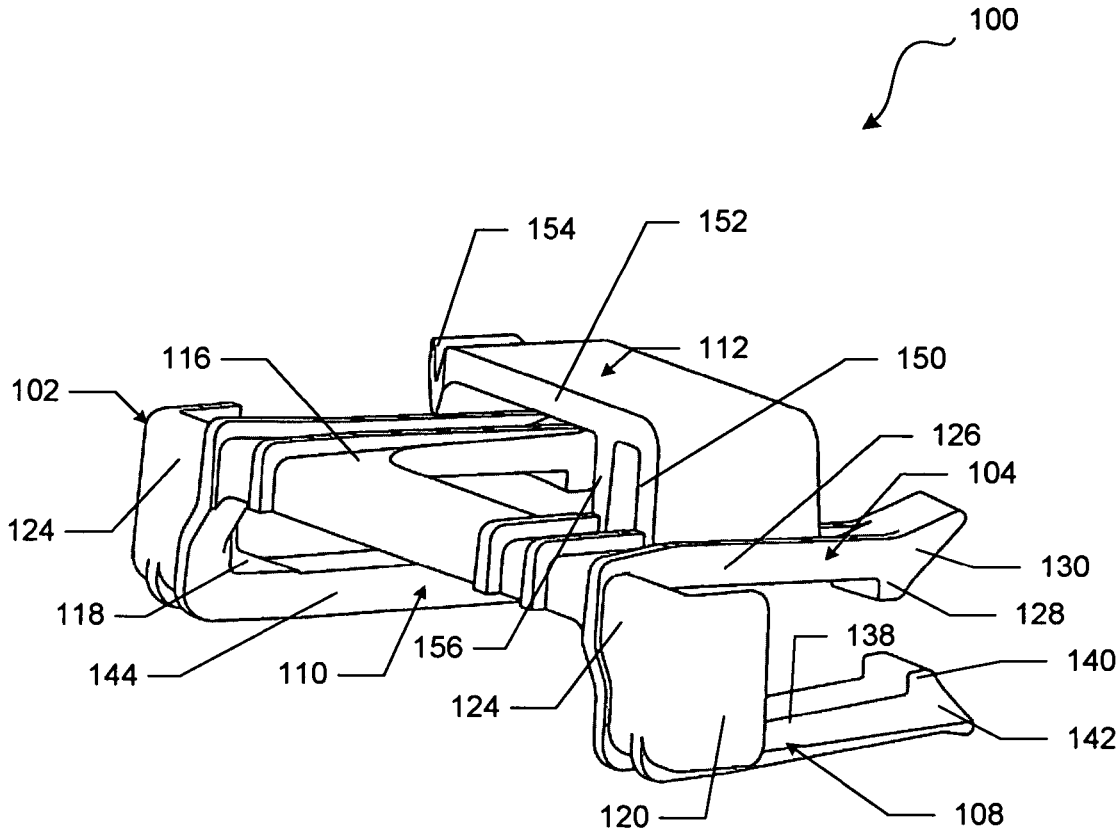
FIG. 2 is a perspective backside view of the cable clip.

FIGS. 1 and 2 show perspective frontside and backside views of a cable clip 100 for an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network server or storage device, a switch router or other network communication device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

The cable clip 100 includes a backing 102, legs 104, 106, 108, and 110, and cable holder 112. The backing 102 includes a top portion 116, a bottom portion 118, a left portion 120, a right portion 122, and a back portion 124 as shown in FIG. 1. The leg 104 has a beam 126, a hook 128, and a release 130. The leg 106 has a beam 132, a hook 134, and a release 136. The leg 108 has a beam 138, a hook 140, and a release 142. The leg 110 has a beam 144, a hook 146, and a release 148. The cable holder 112 has a left portion 150, a top portion 152, a right portion 154, and a support portion 156 as shown in FIG. 1.

The beam 126 of leg 104 extends from the top portion 116 of the backing 102, and the hook 128 and the release 130 are connected to the end of the beam opposite the backing 102. The beam 132 of leg 106 extends from the opposite side of the top portion 116 of the backing 102, and the hook 134 and the release 136 are connected to the end of the beam opposite the backing 102. The beam 138 of leg 108 extends from the bottom portion 118 of the backing 102, and the hook 140 and the release 142 are connected to the end of the beam opposite the backing 102. The beam 144 of leg 110 extends from the opposite side of the top portion 118 of the backing 102, and the hook 146 and the release 148 are connected to the end of the beam opposite the backing 102. The left portion 150 of the cable holder 112 extends perpendicularly from the beam 126 of the leg 104. The top portion 152 of the cable holder 112 extends perpendicularly from the top of the left portion 150 toward the center of the cable clip 100. The right portion 154 of the cable holder 112 extends upwardly from the top portion 152. The support portion 156 of the cable holder 112 extends perpendicularly downward from the top portion 152.

The center of the bottom portion 118 and the back portion 124 are open, such that the cable clip 100 can slide over a cable and align with a connector housing of the cable. The cable can be extended from between the two edges of the back portion 124 and then be routed under the cable holder 112 to be held in position. The cable holder 112 can also route additional cables through the information handling system, such as a server.

Figure 3:
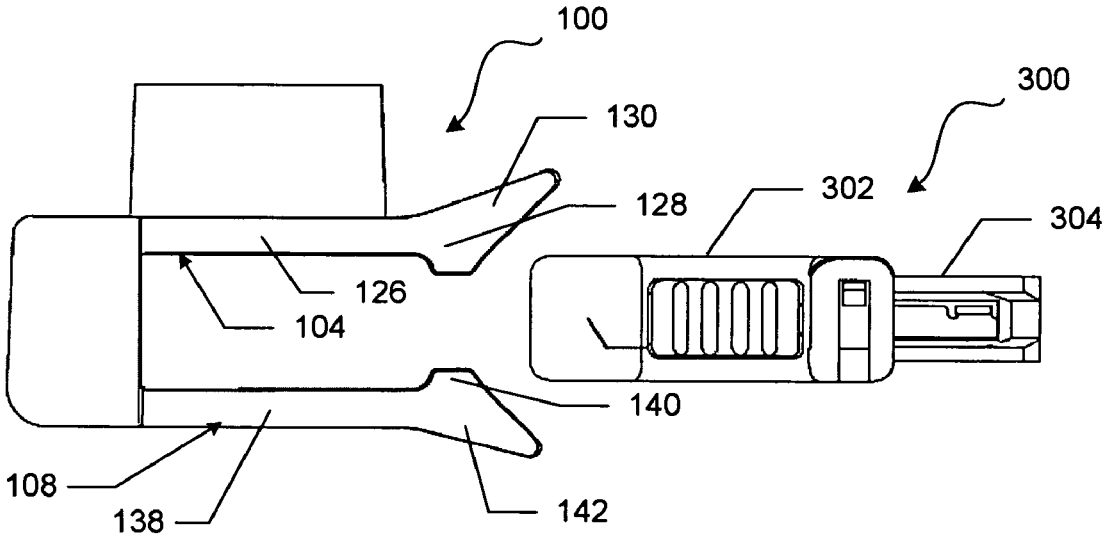
FIG. 3 is a side view of the cable clip and a connector housing in a first position.
Figure 4:
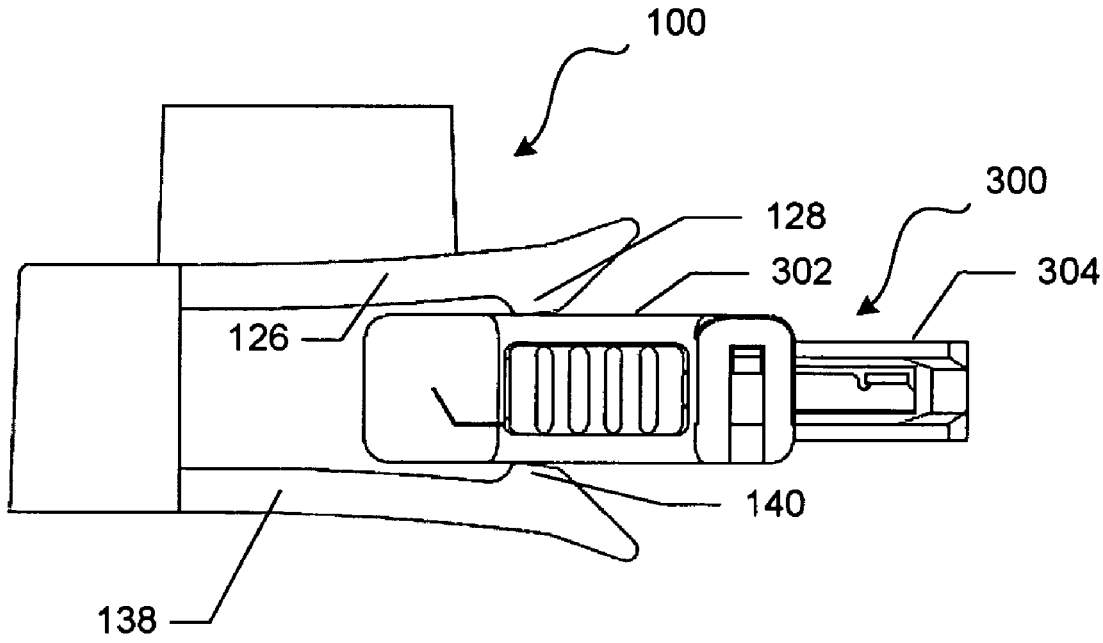
FIG. 4 is a side view of the cable clip and the connector housing in a second position.

FIG. 3 shows the cable clip 100 aligned with a connector housing 300 including a housing 302 and a connector 304 extending from within the housing. Prior to connecting the cable clip 100 with the connector housing 300, the housing 302 may be positioned between the hook 128 of the leg 104 and the hook 140 of the leg 108. This location of the housing 302 allows the connector housing 300 to be slid between the hooks 128 and 140. As the cable clip 100 is pushed into contact with the housing 302, the angled portions of the legs 104 and 108 between the hooks 128 and 140 and the releases 130 and 142 provide force on the beams 126 and 138 to cause the beams to flex away from the housing. Thus, the space between the hooks 128 and 140 can increase to allow the housing 302 to fit between the hooks as shown in FIG. 4.

Figure 5:
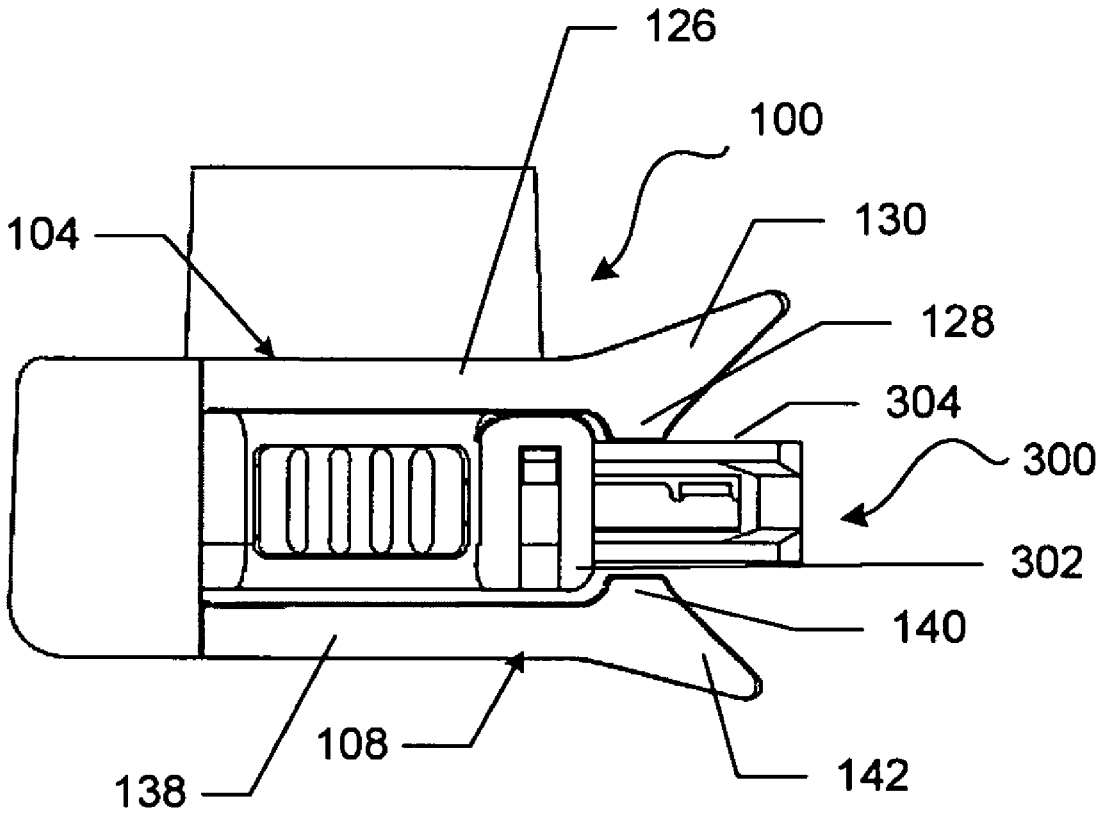
FIG. 5 is a side view of the cable clip and the connector housing in a third position.

As the cable clip is push further onto the connector housing 300, the hooks 128 and 140 slide across the housing 302 as the beams 126 and 138 continue to flex around the housing. Upon the hooks 128 and 140 sliding beyond the housing 302, the beams 126 and 138 release from the flexed position and the hooks snap fit around the housing as shown in FIG. 5.

To release the cable clip 100 from the connector housing 300, a force can be applied to the releases 130 and 142 such that the beams 126 and 138 flex as the hooks 128 and 140 are pushed away from the housing 302 and the connector 304. Upon the hooks 128 and 140 being pushed away from the housing 302, the cable clip can be removed from the connector housing. Even though the connection between the cable clip 100 and the connector housing 300 is described and shown with respect to only legs 104 and 108, it should be understood that the connection is performed similarly with respect to legs 106 and 110.

Figure 6:
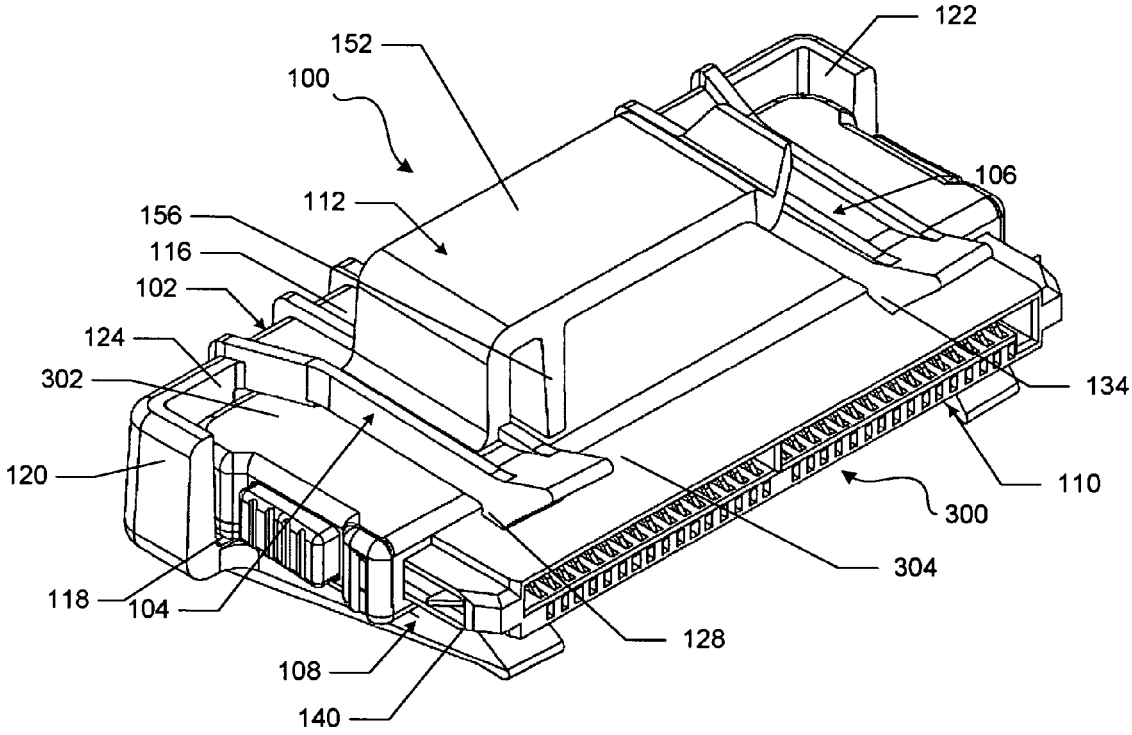
FIG. 6 is a perspective view of the cable clip connected to the connector housing.

FIG. 6 shows a perspective view of the cable clip 100 attached to the connector housing 300. The housing 302 is held between the backing 102 and the legs 104, 106, 108, and 110. The hooks 128, 134, 140, and 146 (not shown) are snap fitted over the housing 302 and are in physical communication with the connector 304. The back of the housing 302 is held securely between the top portion 116, the bottom portion 118, the left portion 120, the right portion 122, and back portion 124 of the backing 102. The cable holder 112 has sufficient space between the top portion 152 and the top of the housing 302 to allow a cable to be routed under the cable holders.

Figure 7:
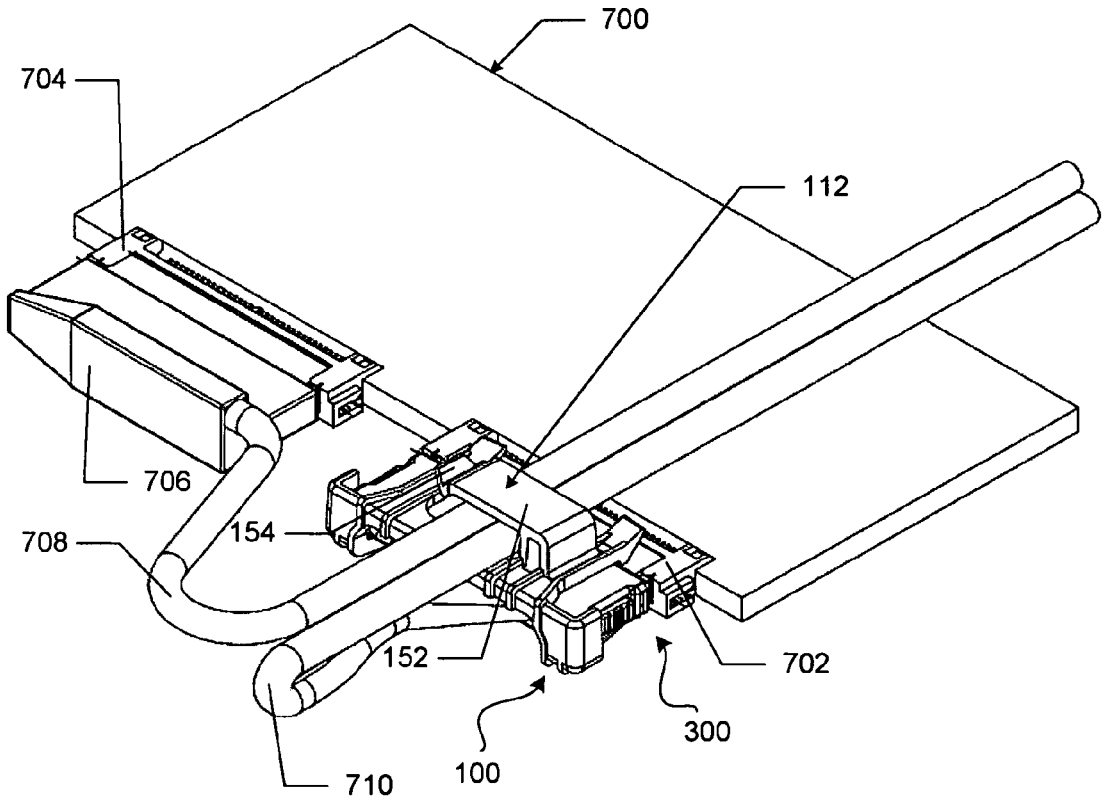
FIG. 7 is a perspective view of the cable clip and the connector housing connected to a circuit board.

FIG. 7 shows a perspective view of the cable clip 100 and the connector housing 300 connected to a circuit board 700 including connecters 702 and 704. A connector housing 706 of a cable 708 can be attached to the connector 704. Additionally, the connector housing 300 is connected to a cable 710, which provides a signal to the connector 304 and the circuit board 700. The cable 710 may be routed over the circuit board 700 to be connected with a portion of the server. The cable 710 can be slid under the right portion 154 of the cable holder 112 by the top portion 152 flexing upwardly from the cable clip 100 such that the cable is placed in the proper location. Thus, the cable holder 112 can hold the cable 710 in position directly over the circuit board 700. The cable holder 112 biases the cable 710 to sit low rather than bulging up where it could interfere with other components of the server and block air flow in the server.

Additionally, the cable clip 100 can be used to route and hold other cables, such as the cable 708, in the information handling system. A force can be applied to the cable holder 112 so that the top portion 152 can flex upwardly from the cable clip 100 and the connector housing 300. Upon the top portion 152 being flexed upwardly from the cable clip 100, the cable 708 can be placed under the right portion 154 and secured under the cable holder. Thus, the cable clip 100 is configured to route multiple cables associated with the circuit board 700.

Figure 8:
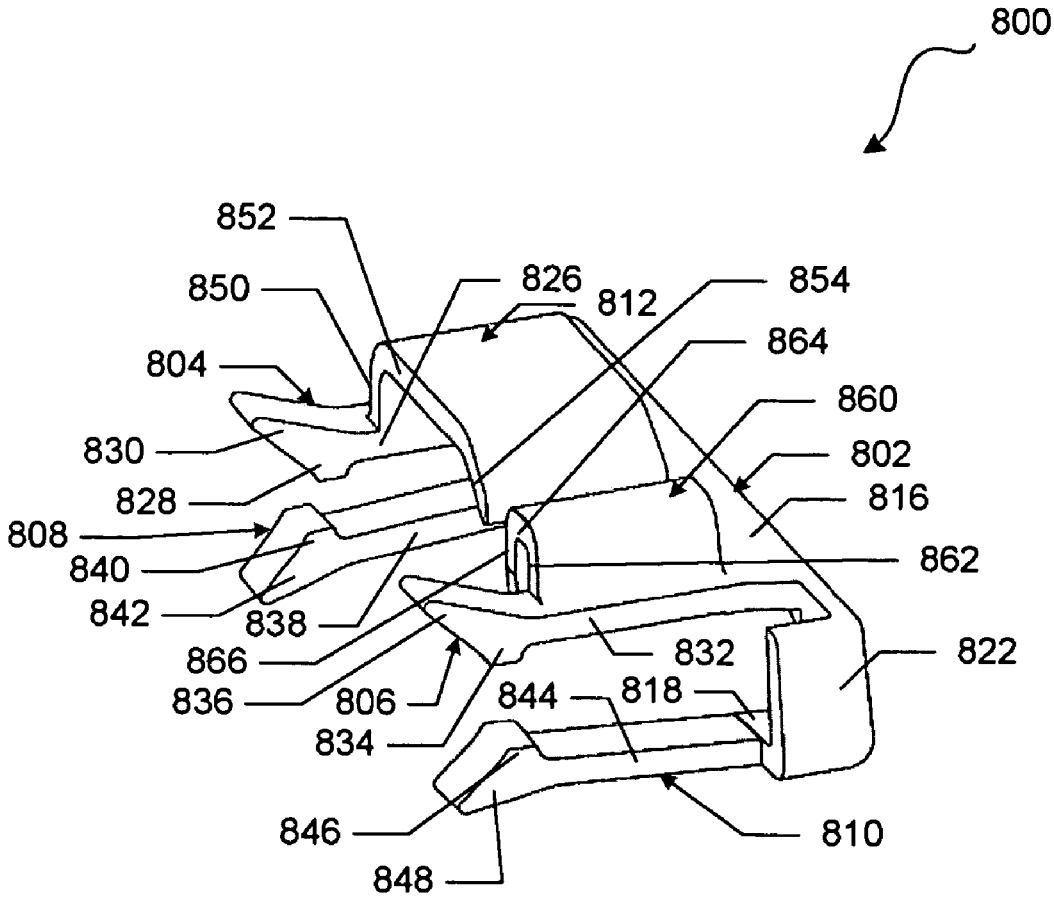
FIG. 8 is a perspective frontside view of an alternative cable clip.

FIG. 8 shows an alternative embodiment of a cable clip 800 including a backing 802, legs 804, 806, 808, and 810, a cable holder 812, and a support 860. The backing 802 includes a top portion 816, a bottom portion 818, a left portion 820, a right portion 822, and a back portion 824 as shown in FIG. 8. The leg 804 has a beam 826, a hook 828, and a release 830. The leg 806 has a beam 832, a hook 834, and a release 836. The leg 808 has a beam 838, a hook 840, and a release 842. The leg 810 has a beam 844, a hook 846, and a release 848. The cable holder 812 has a left portion 850, a top portion 852, and a right portion 854 as shown in FIG. 8. The support 860 has a right portion 862, a top portion 864, and a left portion 864 as shown in FIG. 8.

The beam 826 of leg 804 extends from the top portion 816 of the backing 802, and the hook 828 and the release 830 are connected to the end of the beam opposite the backing 802. The beam 832 of leg 806 extends from the opposite side of the top portion 816 of the backing 802, and the hook 834 and the release 836 are connected to the end of the beam opposite the backing 802. The beam 838 of leg 808 extends from the bottom portion 818 of the backing 802, and the hook 840 and the release 842 are connected to the end of the beam opposite the backing 802. The beam 844 of leg 810 extends from the opposite side of the top portion 818 of the backing 802, and the hook 846 and the release 848 are connected to the end of the beam opposite the backing 802. The left portion 850 of the cable holder 812 extends perpendicularly from the beam 826 of the leg 804. The top portion 852 of the cable holder 812 extends perpendicularly from the top of the left portion 850 toward the center of the cable clip 800. The right portion 854 of the cable holder 812 extends downwardly from the top portion 852. The right portion 862 of the support 860 extends perpendicularly upward from the beam 832 of the leg 806. The top portion 864 of the support 860 extends perpendicularly from the top of the right portion 862 toward the center of the cable clip 800. The left portion 866 of the support 860 extends perpendicularly downward from the left of the top portion 864.

The center of the bottom portion 818 and the back portion 824 are open, such that the cable clip 800 can slide over a cable and align with a connector housing of the cable. The cable can be extended from between the two edges of the back portion 824 and then be routed under the cable holder 812 to be held in position. The cable holder 812 can also route additional cables through the information handling system, such as a server. The support 860 can further support the cable clip 800 on the connector housing of the cable.

Figure 9:
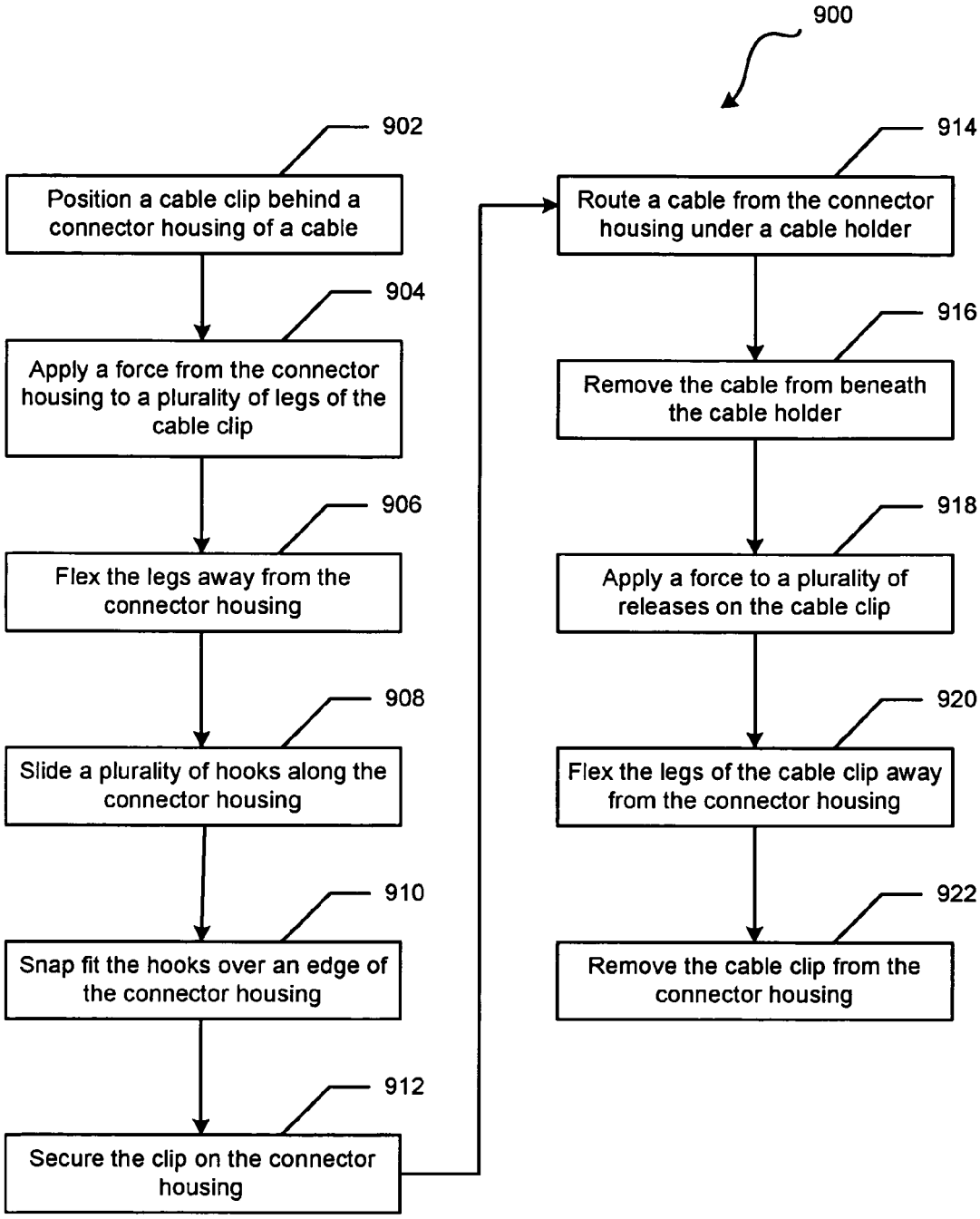
FIG. 9 is a flow diagram of a method for connecting the cable clip to the connector housing.

FIG. 9 shows a flow diagram of a method 900 for connecting a cable clip to a connector housing of a cable. At block 902, the cable clip is positioned behind the connector housing, with the connector housing being positioned between a plurality of hooks. A force is applied from the connector housing to a plurality of legs of the cable clip at block 904. At block 906, the legs of the cable clip are flexed away from the connector housing. The hooks of the cable clip are slid across the connector housing at block 908. At block 910, the hooks are snap fitted over an edge of the connector housing. The cable clip is secured on the connector housing at block 912. At block 914, a cable from the connector housing is routed under a cable holder of the cable clip. At block 916, the cable is removed from beneath the cable holder. A force is applied to a plurality of releases on the cable clip at block 918. At block 920, the legs of the cable clip are flexed away from the connector housing. The cable clip is removed from the connector housing at block 922.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A cable clip for a connector housing, the cable clip comprising:

a backing configured to be placed in physical communication with the connector housing;

a first portion extending from a first edge of a first side of the backing, the first portion having a first hook opposite the first side of the backing, the first portion adapted to flexibly slide over the connector housing and snap fit the first hook around the connector housing; and a second portion extending from a second edge of the first side of the backing, the second portion having a second hook opposite the first side of the backing, the second portion adapted to flexibly slide over the connector housing and snap fit the second hook around the connector housing;

wherein the cable clip is configured to route a plurality of cables within a server.

2. The cable clip of claim 1 further comprising:

a third portion extending from a first corner formed by a second side and a third side of the backing, the third portion having a third hook opposite the first corner of the backing, the third portion adapted to flexibly slide over the connector housing and snap fit the third hook around the connector housing.

3. The cable clip of claim 2 further comprising:

a fourth portion extending from a second corner formed by the third side and a fourth side of the backing, the fourth portion having a fourth hook opposite the second corner of the backing, the fourth portion adapted to flexibly slide over the connector housing and snap fit the fourth hook around the connector housing.

4. The cable clip of claim 1 further comprising:

a cable holder extending from the first portion, the cable holder adapted to route a first cable from the connector housing to a desired location in the server.

5. The cable clip of claim 4 wherein the cable holder is adapted to prevent the first cable from blocking airflow in the server.

6. The cable clip of claim 4 wherein the cable holder is further adapted to route a second cable from a first location in the server to a second location in the server.

7. The cable clip of claim 6 wherein the cable holder is adapted to prevent the second cable from blocking airflow in the server.

8. A system comprising:

a first cable having a connector housing; and a cable clip attachable to the first cable, the cable clip including:

a backing configured to be placed in physical communication with the connector housing;

a first portion extending from a first edge of a first side of the backing, the first portion having a first hook opposite the first side of the backing, the first portion adapted to flexibly slide over the connector housing and snap fit the first hook around the connector housing; and a second portion extending from a second edge of the first side of the backing, the second portion having a second hook opposite the first side of the backing, the second portion adapted to flexibly slide over the connector housing and snap fit the second hook around the connector housing;

wherein the cable clip is configured to route the first cable within a server.

9. The cable clip of claim 8 further comprising:

a third portion extending from a first corner formed by a second side and a third side of the backing, the third portion having a third hook opposite the first corner of the backing, the third portion adapted to flexibly slide over the connector housing and snap fit the third hook around the connector housing.

10. The cable clip of claim 9 further comprising:

a fourth portion extending from a second corner formed by the third side and a fourth side of the backing, the fourth portion having a fourth hook opposite the second corner of the backing, the fourth portion adapted to flexibly slide over the connector housing and snap fit the fourth hook around the connector housing.

11. The cable clip of claim 8 further comprising:

a cable holder extending from the first portion, the cable holder adapted to route the first cable from the connector housing to a desired location in the server.

12. The cable clip of claim 11 wherein the cable holder is adapted to prevent the first cable from blocking airflow in the server.

13. The cable clip of claim 11 wherein the cable holder is further adapted to route a second cable from a first location in the server to a second location in the server.

14. The cable clip of claim 13 wherein the cable holder is adapted to prevent the second cable from blocking airflow in the server.

15. A system comprising:

a circuit board attachable to a server;

a first cable attachable to the circuit board, the cable including a connector housing; and a cable clip attachable to the first cable, the cable clip including:

a backing configured to be placed in physical communication with the connector housing;

a first portion extending from a first edge of a first side of the backing, the first portion having a first hook opposite the first side of the backing, the first portion adapted to flexibly slide over the connector housing and snap fit the first hook around the connector housing; and a second portion extending from a second edge of the first side of the backing, the second portion having a second hook opposite the first side of the backing, the second portion adapted to flexibly slide over the connector housing and snap fit the second hook around the connector housing;

wherein the cable clip is configured to route the first cable within the server.

16. The cable clip of claim 15 further comprising:

a third portion extending from a first corner formed by a second side and a third side of the backing, the third portion having a third hook opposite the first corner of the backing, the third portion adapted to flexibly slide over the connector housing and snap fit the third hook around the connector housing.

17. The cable clip of claim 16 further comprising:

a fourth portion extending from a second corner formed by the third side and a fourth side of the backing, the fourth portion having a fourth hook opposite the second corner of the backing, the fourth portion adapted to flexibly slide over the connector housing and snap fit the fourth hook around the connector housing.

18. The cable clip of claim 15 further comprising:

a cable holder extending from the first portion, the cable holder adapted to route the first cable from the connector housing to a desired location in the server.

19. The cable clip of claim 18 wherein the cable holder is further adapted to route a second cable from a first location in the server to a second location in the server.

20. The cable clip of claim 19 wherein the cable holder is adapted to prevent the first cable and the second cable from blocking airflow in the server.

* * * * *